US009343857B2

(12) United States Patent
Suzuki

(10) Patent No.: US 9,343,857 B2
(45) Date of Patent: May 17, 2016

(54) JACK

(71) Applicant: SMK Corporation, Tokyo (JP)

(72) Inventor: Hiroshi Suzuki, Hitachi (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 14/699,006

(22) Filed: Apr. 29, 2015

(65) Prior Publication Data

US 2015/0380883 A1 Dec. 31, 2015

(51) Int. Cl.
*H01R 24/00* (2011.01)
*H01R 24/58* (2011.01)

(52) U.S. Cl.
CPC ..... *H01R 24/58* (2013.01)

(58) Field of Classification Search
CPC ..... H01R 24/58; H01R 2201/12
USPC ..... 439/669, 909, 668, 667
See application file for complete search history.

(56) References Cited

U.S. PATENT DOCUMENTS 6,494,746 B2 * 12/2002 D'Addario ..... H01R 13/17 439/668
7,204,720 B1 * 4/2007 Shiu ..... H01R 13/502 439/668
8,376,789 B2 * 2/2013 Jol ..... H01R 13/187 439/668

FOREIGN PATENT DOCUMENTS

JP 2013-085138 A 5/2013

* cited by examiner

*Primary Examiner* — Phuongchi T Nguyen
(74) *Attorney, Agent, or Firm* — Locke Lord LLP

(57) ABSTRACT

There is provided a jack that can be easily applied to an electronic device adopting a design where an outer edge portion of a casing is formed in an arc or tapered shape.

1 Claim, 9 Drawing Sheets

Prior Art

JACK

CROSS REFERENCE TO RELATED APPLICATION

This application claims priority to Japanese Application No. 2014-132452 filed Jun. 27, 2014 which is assigned to the assignee of the present application and is incorporated by reference herein.

BACKGROUND

1. Technical Field

The present invention relates to a jack such as a small jack which is used to connect an external connecting terminal to an electronic device such as a mobile phone or a smartphone.

2. Related Art

Conventionally, there are electronic devices such as smartphones and portable audio players that adopt a design where an outer edge portion of a casing (set chassis) is formed in an arc or tapered shape. There is developed a jack 200 such as a small jack which is mounted on such electronic devices and is provided with a tapered sloping portion 202 at a front surface portion of a housing 201 as shown in FIG. 10 so as to match the design of an electronic device casing (see, for example, JP 2013-85138 A).

Meanwhile, there is known a jack of this type having a housing made of an insulating resin and having a plug insertion portion into which a plug is inserted; and a plurality of contacts retained on the housing such that elastic contact piece portions thereof project into the plug insertion portion, and by disposing the contacts at both side portions of the housing which sandwich the plug insertion portion, a reduction in height is achieved.

The contacts each have a fixed piece portion fixed on both sides of the housing which sandwich the plug insertion portion; and an elastic contact piece portion supported on the fixed piece portion. A contact point at a front end of the elastic contact piece portion projects into the plug insertion portion from a side portion of the housing, and the contacts are disposed at intervals in a plug insertion direction.

SUMMARY

However, in the above-described conventional jack, when the contacts are retained on the side portions of the housing, since the inclination angle θ of the sloping portion 202 provided to the housing is naturally limited by the distance from a front end to a contact closest to the front and the height of the contact, there is a problem that the design of an outer edge portion of a casing of an electronic device to which the jack can be applied is limited.

In view of such a conventional problem, an object of the present invention is therefore to provide a jack that can be easily applied to an electronic device adopting a design where an outer edge portion of a casing (set chassis) is formed in an arc or tapered shape.

To solve the conventional problems described above and achieve the intended purpose, a first aspect of the present invention provides a jack including: a housing made of an insulating resin and having a plug insertion portion into which a plug is inserted; and a plurality of contacts retained on side portions of the housing such that contact points of the contacts project into the plug insertion portion, wherein the housing has a low-height portion on a front side thereof and is formed such that the low-height portion and a rear of the low-height portion form a step-like shape, the contacts include a low-height contact disposed at a side portion of the low-height portion; and a holding spring/contact disposed at a side portion of a rear step portion of the housing, the low-height contact has: a fixed piece portion fixed at the side portion of the low-height portion; a folded portion formed in a folded manner from an upper edge of the fixed piece portion; an elastic contact portion extending in an obliquely downward transverse direction from a front end of the folded portion; and a contact point integrally formed at a front end of the elastic contact portion, and the contact point projects into the plug insertion portion from a bottom side of the low-height portion.

In addition to the configuration of the first aspect, according to a second aspect of the present invention, the housing has a low-height contact accommodation portion into which the low-height contact is incorporated from an undersurface of the housing, the low-height contact accommodation portion has: a temporary fixation pressure contact portion that comes into contact with the folded portion upon incorporation of the low-height contact; and a preload portion that comes into contact with the elastic contact portion, with the low-height contact incorporated, and when the preload portion comes into contact with the elastic contact portion, the folded portion is separated from the temporary fixation pressure contact portion.

As described above, a jack according to the present invention includes: a housing made of an insulating resin and having a plug insertion portion into which a plug is inserted; and a plurality of contacts retained on side portions of the housing such that contact points of the contacts project into the plug insertion portion. The housing has a low-height portion on a front side thereof and is formed such that the low-height portion and a rear of the low-height portion form a step-like shape. The contacts include a low-height contact disposed at a side portion of the low-height portion; and a holding spring/contact disposed at a side portion of a rear step portion of the housing. The low-height contact has: a fixed piece portion fixed at the side portion of the low-height portion; a folded portion formed in a folded manner from an upper edge of the fixed piece portion; an elastic contact portion extending in an obliquely downward transverse direction from a front end of the folded portion; and a contact point integrally formed at a front end of the elastic contact portion. The contact point projects into the plug insertion portion from a bottom side of the low-height portion. By this, the low-height portion can be provided and the contact can be disposed at the side portion of the low-height portion. Accordingly, a space is created above the low-height portion, and by using the space the flexibility in the design of an electronic device casing is improved.

In addition, in the present invention, the housing has a low-height contact accommodation portion into which the low-height contact is incorporated from an undersurface of the housing. The low-height contact accommodation portion has: a temporary fixation pressure contact portion that comes into contact with the folded portion upon incorporation of the low-height contact; and a preload portion that comes into contact with the elastic contact portion, with the low-height contact incorporated. When the preload portion comes into contact with the elastic contact portion, the folded portion is separated from the temporary fixation pressure contact portion. By this, upon incorporation of the low-height contact, the low-height contact can be temporarily fixed, and after mounting, a load (preload) is always applied to the whole spring composed of the elastic contact portion and the folded portion and thus a stable contact state can be maintained with a plug.

DETAILED DESCRIPTION

Figure 1A:
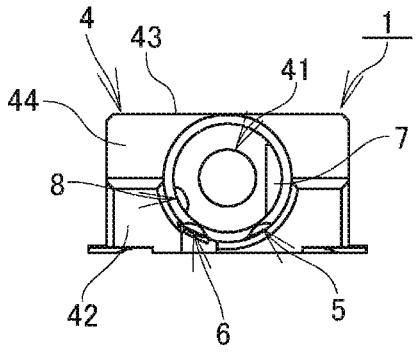
FIG. 1A is a front view showing a jack according to the present invention.
Figure 1B:
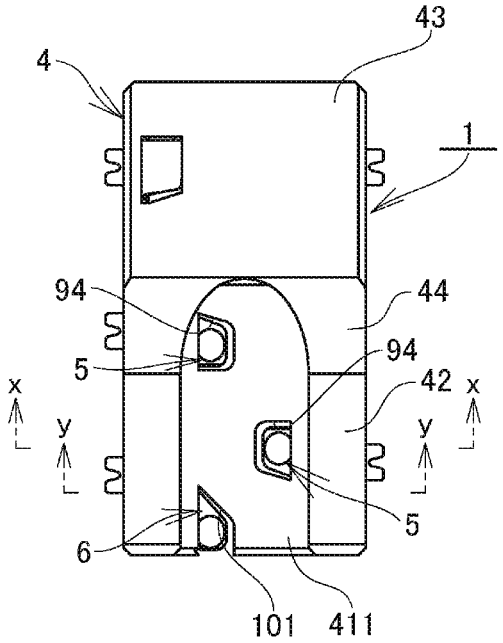
FIG. 1B is a plan view of the jack.
Figure 1C:
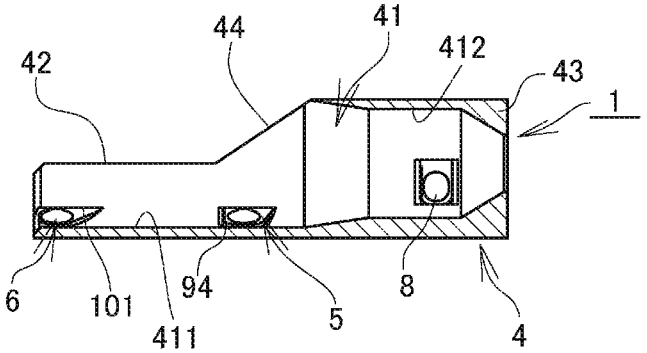
FIG. 1C is a longitudinal cross-sectional view of the jack.
Figure 2:
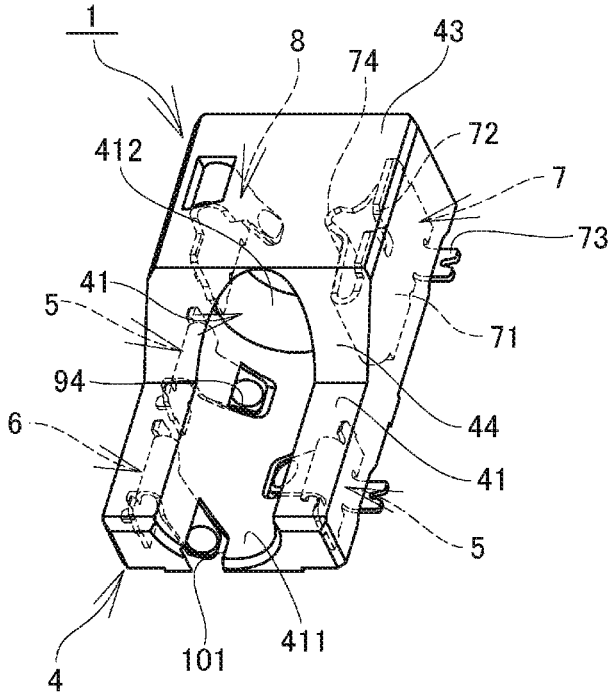
FIG. 2 is a partially see-through perspective view of the jack.

Next, an embodiment of a jack according to the present invention will be described based on an implementation example shown in FIGS. 1A to 1C to 9. Note that in the drawings reference numeral 1 indicates a jack such as a small jack, reference numeral 2 indicates an electronic device casing (set chassis) on which the jack 1 is mounted, and reference numeral 3 indicates a plug.

In addition, the present implementation example makes a description such that the front side in a plug insertion direction is referred to as "front", and with reference to the up-down and left-right directions in FIG. 1A the up-down direction is referred to as "longitudinal" and the left-right direction as "transverse".

The jack 1 has a housing 4 made of an insulating resin and having a plug insertion portion 41 into which the plug 3 is inserted; and a plurality of contacts 5 to 8 retained on side portions of the housing 4 such that contact points thereof project into the plug insertion portion 41. The contact points of the contacts 5 to 8 come into contact with an outer region of the plug 3 inserted into the plug insertion portion 41.

Figure 4A:
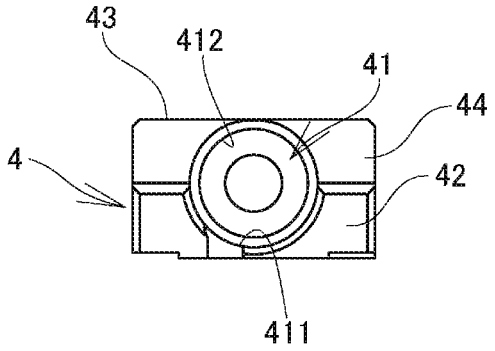
FIG. 4A is a front view showing a housing of FIGS. 1A to 1C.
Figure 4B:
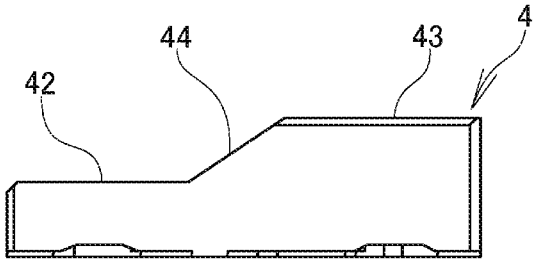
FIG. 4B is a right side view of the housing.
Figure 4C:
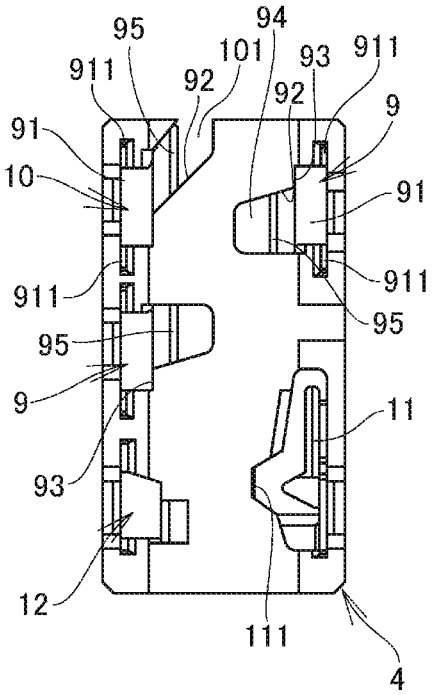
FIG. 4C is a bottom view of the housing.

As shown in FIGS. 4A to 4C, the housing 4 is integrally formed of an insulating resin and has a low-height portion 42 disposed on the front side thereof and a rear step portion 43 disposed at the rear of the low-height portion 42. The housing 4 is formed such that the rectangular parallelepiped low-height portion 42 and rear step portion 43 having different heights form a step-like shape as viewed from the side, with a flat undersurface.

In addition, a sloping portion 44 which slopes from a top surface of the rear step portion 43 toward a top surface of the low-height portion 42 is formed at a portion where the low-height portion 42 and the rear step portion 43 are connected to each other.

The low-height portion 42 is formed in a shape where an upper half portion of a front-side portion of the housing 4 is removed, i.e., a shape where a rectangular parallelepiped structure having, at the center thereof, a round hole opened in a front surface is halved and an upper half portion thereof is removed, and has a height that is substantially half that of the rear step portion 43.

The plug insertion portion 41 is configured to have a halved portion 411 where the top-surface side of the low-height portion 42 is dented semicircularly; and a holding hole portion 412 of a round hole shape which continues with the halved portion 411 in a front-rear direction. The plug 3 is inserted such that the front end side thereof is inserted into the holding hole portion 412 and the base end side thereof is inserted into the halved portion 411 with an upper half portion thereof exposed.

Figure 3:
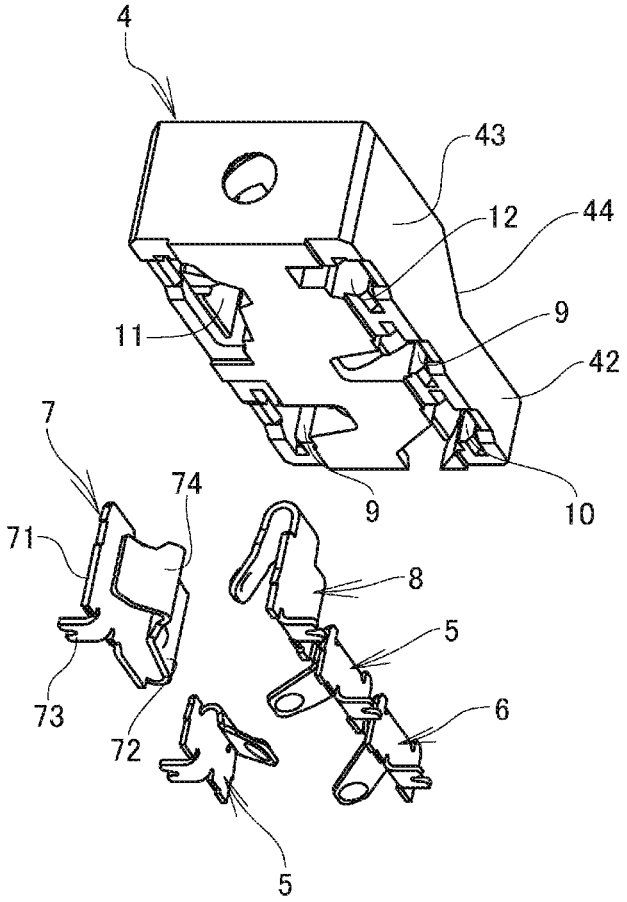
FIG. 3 is an exploded perspective view of the jack.

In addition, as shown in FIGS. 3 and 4C, the housing 4 has contact accommodation portions 9 to 12 opened in the undersurface thereof which are formed at both side portions sandwiching the plug insertion portion 41. Into the contact accommodation portions 9 to 12 are incorporated the corresponding contacts 5 to 8 from the undersurface side.

Note that those contact accommodation portions disposed at the low-height portion 42 are referred to as the low-height contact accommodation portions 9 and 10, and a contact accommodation portion disposed at one side portion of the rear step portion 43 is referred to as the holding spring/contact accommodation portion 11. The low-height contacts 5 and 6 are incorporated into the low-height contact accommodation portions 9 and 10, and the holding spring/contact 7 is incorporated into the holding spring/contact accommodation portion 11.

As shown in FIGS. 5A to 5C and 6A to 6C, each of the low-height contacts 5 and 6 is integrally formed by performing press working on an elastic conductive metal plate, and has a fixed piece portion 51 fixed in a longitudinal direction at a side portion of the low-height portion 42; a folded portion 52 formed in a folded manner from an upper edge of the fixed piece portion 51; an elastic contact portion 53 extending in an obliquely downward transverse direction from the folded portion 52; a contact point 54 integrally formed at a front end of the elastic contact portion 53; and a connecting terminal portion 55 extending in a transverse direction from a lower edge of the fixed piece portion 51. The folded portion 52 and the elastic contact portion 53 form a cantilever spring structure supported on the fixed piece portion 51.

The fixed piece portion 51 is formed in a rectangular plate shape standing up in the longitudinal direction and has, at both side edges thereof, catching protrusions 511 and 511 for catching which are protrudingly and integrally formed therewith. The fixed piece portion 51 is formed to have a height that matches the height of both side portions of the low-height portion 42.

The folded portion 52 is formed by bending a conductive metal plate in an arc shape from the upper edge of the fixed piece portion 51, and integrally supports the elastic contact portion 53 on the front end side thereof.

The width in the front-rear direction of the folded portion 52 is wider than the width in the front-rear direction of a base end of the elastic contact portion 53. The folded portion 52 has a temporary fixation step portion 521 formed at a front end edge thereof.

The length from the base end to front end of the elastic contact portion 53 is such a length that the front end of the elastic contact portion 53 substantially reaches the plug insertion portion 41, i.e., the bottom of the halved portion 411, upon incorporation of the low-height contact 5, 6 into the housing 4. The contact point 54 projects into the plug insertion portion 41 from the bottom side of the low-height portion 42.

The contact point 54 is integrally formed at the front end of the elastic contact portion 53 by allowing the front end of the elastic contact portion 53 to bulge by pressing.

Figure 5A:
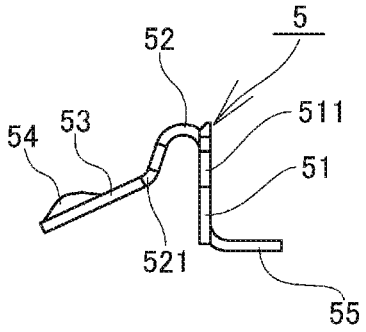
FIG. 5A is a front view showing an example of a low-height contact.
Figure 5B:
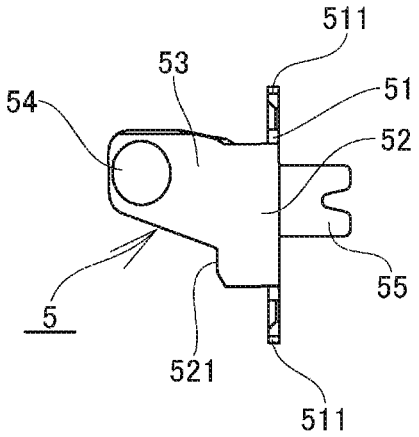
FIG. 5B is a plan view of the low-height contact.
Figure 5C:
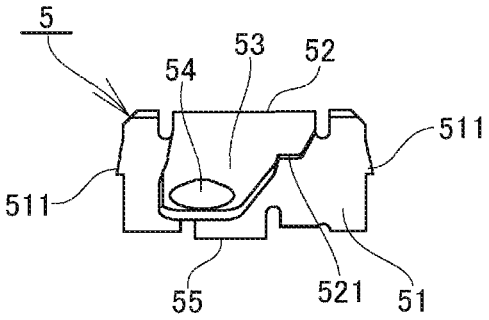
FIG. 5C is a left side view of the low-height contact.
Figure 6A:
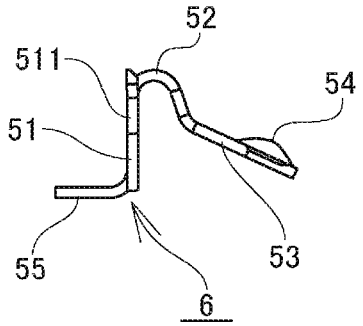
FIG. 6A is front view showing another example of a low-height contact.
Figure 6B:
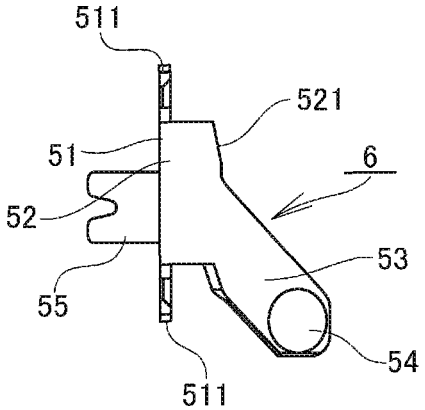
FIG. 6B is a plan view of the low-height contact.
Figure 6C:
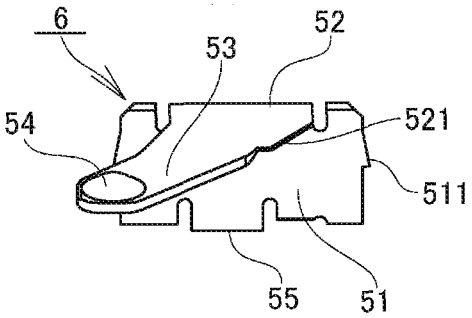
FIG. 6C is a right side view of the low-height contact.

Note that the low-height contact 6 is configured in the same manner as the low-height contact 5 shown in FIGS. 5A to 5C, but since a contact position of the low-height contact 6 with the plug 3 is a front-side position, the elastic contact portion 53 is in the shape of extending obliquely forward.

Each of the low-height contact accommodation portions 9 and 10 has a main body accommodation hole 91 of a rectangular hole shape; and an elastic contact portion accommodation hole 92 which communicates with the main body accommodation hole 91. The fixed piece portion 51 and the folded portion 52 are inserted into the main body accommodation hole 91, and the elastic contact portion 53 is inserted into the elastic contact portion accommodation hole 92.

In addition, in the low-height contact accommodation portions 9 and 10, as shown in FIGS. 1A to 1C and 4A to 4C, projection windows 94, 94, and 101 communicating with the plug insertion portion 41 are disposed in a staggered manner at a bottom portion of the plug insertion portion 41, i.e., the halved portion 411. The contact points 54 of the low-height contacts 5 and 6 project into the plug insertion portion 41 from the bottom side of the low-height contact accommodation portions 9 and 10.

Figure 7:
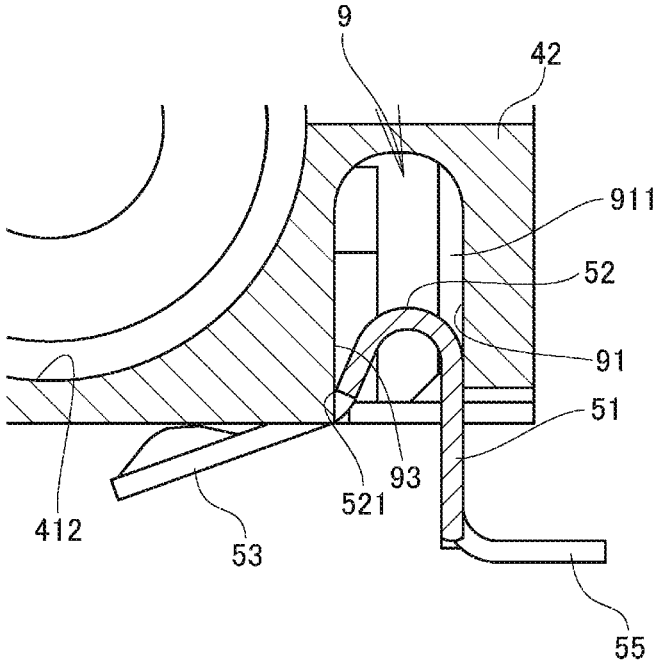
FIG. 7 is an enlarged cross-sectional view taken along line x-x of FIG. 1B, showing a temporary fixing state of the low-height contact.

As shown in FIGS. 4C and 7, each main body accommodation hole 91 makes a longitudinal hole opened in the undersurface, at a side portion of the low-height portion 42. Press-fitting grooves 911 and 911 into which both side edges of the fixed piece portion 51 are press-fit are formed on the outer side of both end portions in the front-rear direction of the main body accommodation hole 91. The catching protrusions 511 are engaged and caught in the inner surfaces of the press-fitting grooves 911, by which the fixed piece portion 51 is fixed to the housing 4.

The main body accommodation hole 91 and the elastic contact portion accommodation hole 92 are disposed such that boundary portions thereof are shifted from each other in the front-rear direction so as to match the shape of the low-height contact 5, 6. By the shift in the front-rear direction, an inner surface of the main body accommodation hole 91 forms a temporary fixation pressure contact portion 93.

Then, upon incorporation of the low-height contact 5, 6 into the low-height portion 42, as shown in FIG. 7, the temporary fixation step portion 521 of the folded portion 52 comes into contact with the temporary fixation pressure contact portion 93, by which the folded portion 52 bends.

By this, in the low-height contact 5, 6, by a spring reaction force of the folded portion 52, the temporary fixation step portion 521 and the fixed piece portion 51 press an inner surface of the main body accommodation portion. By the pressing force, the low-height contact 5, 6 is retained on the housing 4, enabling temporary fixation of the low-height contact 5, 6 to the housing 4 upon assembling. Accordingly, assembling work can be smoothly performed.

Figure 8A:
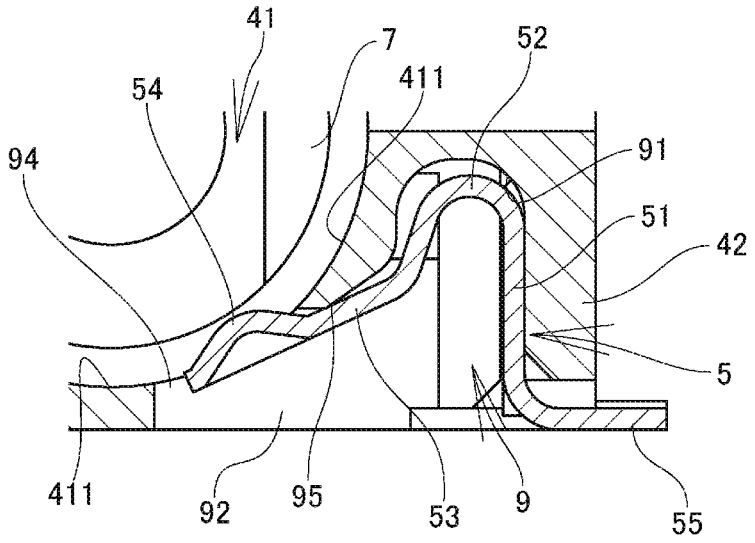
FIG. 8A is an enlarged cross-sectional view taken along line y-y of FIG. 1B, showing a state in which the low-height contact is mounted.

Meanwhile, as shown in FIG. 8A, the elastic contact portion accommodation hole 92 is made in a shape where a top surface thereof slopes from the main body accommodation hole 91 toward the central bottom side of the low-height portion 42. The central bottom side communicates with the plug insertion portion 41 by the projection window 94, and the contact point 54 projects into the plug insertion portion 41 through the projection window 94.

Each of the projection windows 94 and 101 is formed to match the shape of the elastic contact portion 53, and an outer opening edge portion thereof on the accommodation hole side forms a preload portion 95.

As shown in FIG. 8A, the preload portion 95 comes into contact with an area near the contact point 54 of the elastic contact portion 53, with the low-height contact 5, 6 incorporated. The preload portion 95 presses the elastic contact portion 53 downward.

Figure 8B:
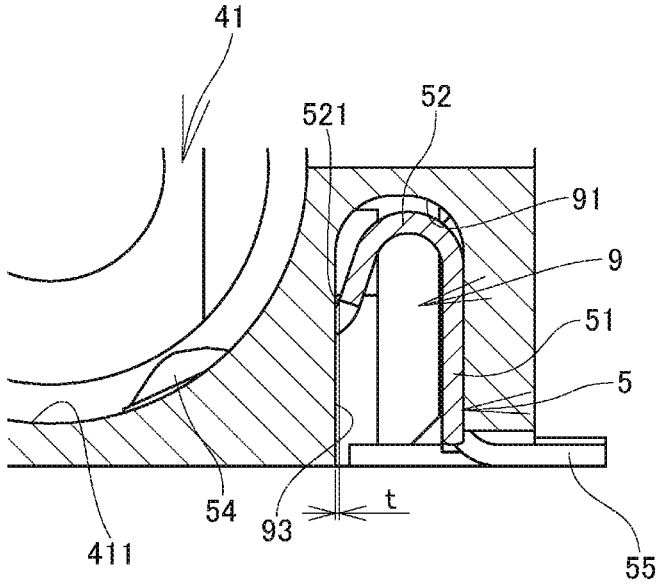
FIG. 8B is an enlarged cross-sectional view taken along line x-x of FIG. 1B.

Then, when the preload portion 95 comes into contact with the elastic contact portion 53, the folded portion 52 and the elastic contact portion 53 which are supported on the fixed piece portion 51 bend, and as shown in FIG. 8B, the folded portion 52 is separated from the temporary fixation pressure contact portion 93, generating a gap t between the folded portion 52 and the temporary fixation pressure contact portion 93.

Note that, the low-height contact accommodation portion 10 slightly differs from the low-height contact accommodation portion 9 in the shapes of the elastic contact portion accommodation hole 92 and the projection window 101 so as to match the shape of the contact, but is configured in substantially the same manner as the low-height contact accommodation portion 9.

The holding spring/contact 7 is integrally formed by performing press working on a conductive metal plate, and has a fixed piece portion 71 fixed in the longitudinal direction at a side portion of the rear step portion 43; an elastic contact portion 72 in the shape of being folded inward from a side edge of the fixed piece portion 71; and a connecting terminal portion 73 extending outward from a lower edge of the fixed piece portion 71. A contact point 74 bulging inward is integrally formed on the front end side of the elastic contact portion 72.

The holding spring/contact accommodation portion 11 communicates with the plug insertion portion 41 through a projection window 111 which is opened so as to communicate with a side surface portion of the plug insertion portion 41. The contact point 74 projects into the plug insertion portion 41 in the transverse direction through the projection window 111, and thereby comes into contact with an outer surface of the plug 3 inserted into the plug insertion portion 41.

The holding spring/contact 7 is accommodated in the rear step portion 43. By the elastic contact portion 72 having the shape of being folded from the side edge of the fixed piece portion 71, the longitudinal width of the elastic contact portion 72 can have a width that matches the height of the rear step portion 43, enabling to ensure high spring pressure. Thus, a sense of clicking upon inserting or removing the plug 3 and holding power can be obtained.

In the jack 1 thus configured, the low-height contact 5, 6 has the folded portion 52 and the elastic contact portion 53 extending in the obliquely downward transverse direction from the front end of the folded portion 52. By the contact point 54 projecting into the plug insertion portion 41 from the bottom side of the low-height portion 42, while a sufficient spring span is ensured, even if a downward reaction force acts from the outer surface of the plug 3, the downward force is distributed by the provision of the folded portion 52, enabling to reduce the load on the fixed piece portion 51. Thus, even if the height of the fixed piece portion 51 is made lower than that of conventional ones, the downward force can be counteracted.

Figure 9:
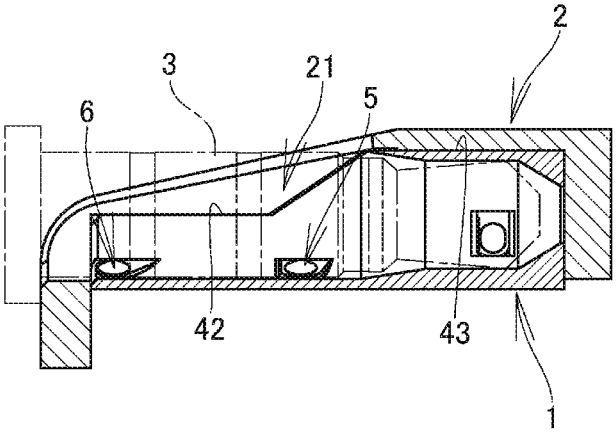
FIG. 9 is a longitudinal cross-sectional view showing an example of a use mode of the jack according to the present invention.
Figure 10:
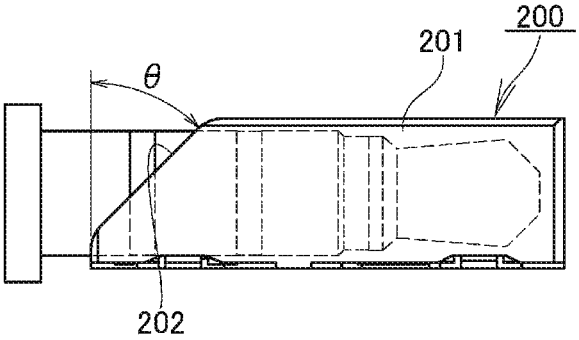
FIG. 10 is a side view showing an example of a conventional jack.

Therefore, the low-height portion 42 can be formed to have a height substantially half that of the rear step portion 43. For example, as shown in FIG. 9, a space 21 inside the casing which is created by the provision of the low-height portion 42 can be used freely, increasing the degree of flexibility in the design of the electronic device casing (set chassis) 2.

In addition, by separately providing the temporary fixation pressure contact portion 93 and the preload portion 95 to the low-height contact accommodation portions 9 and 10, upon incorporation of a contact, the contact can be temporarily fixed, and a spring composed of the elastic contact portion 53 and the folded portion 52 is allowed to bend, enabling to bring a state in which a spring reaction force is always acting (preload). Thus, a stable contact state can be maintained with the plug 3 inserted into the plug insertion portion 41.

Note that although the above-described implementation example describes an example in which the sloping portion 44 is provided to the housing 4, the low-height portion 42 and the rear step portion 43 may form a step-like shape.

Note also that the contact 8 is not particularly limited to the mode of the above-described implementation example. For example, the contact 8 may have the same mode as the holding spring/contact 7 or may have other modes.

DESCRIPTION OF REFERENCE NUMERALS

1: jack
2: electronic device casing (set chassis)
3: plug
4: housing
41: plug insertion portion
411: halved portion
412: holding hole portion
42: low-height portion
43: rear step portion
44: sloping portion
5: low-height contact
51: fixed piece portion
511: catching protrusion
52: folded portion
521: temporary fixation step portion
53: elastic contact portion
54: contact point
55: connecting terminal portion
6: low-height contact
7: holding spring/contact
71: fixed piece portion
72: elastic contact portion
73: connecting terminal portion
74: contact point
8: contact
9: low-height contact accommodation portion
91: main body accommodation hole
911: press-fitting groove
92: elastic contact portion accommodation hole
93: temporary fixation pressure contact portion
94: projection window
95: preload portion
10: low-height contact accommodation portion
101: projection window
11: holding spring/contact accommodation portion
111: projection window
12: contact accommodation portion

What is claimed is:

1. A jack comprising:

a housing made of an insulating resin and having a plug insertion portion into which a plug is inserted; and a plurality of contacts retained on side portions of the housing such that contact points of the contacts project into the plug insertion portion, wherein the housing has a low-height portion on a front side thereof and is formed such that the lo low-height portion and a rear of the low-height portion form a step-like shape, the contacts include a low-height contact disposed at a side portion of the low-height portion; and a holding spring/contact disposed at a side portion of a rear step portion of the housing, the low-height contact has:

a fixed piece portion fixed at the side portion of the low-height portion;

a folded portion formed in a folded manner from an upper edge of the fixed piece portion;

an elastic contact portion extending in an obliquely downward transverse direction from a front end of the folded portion; and a contact point integrally formed at a front end of the elastic contact portion, and the contact point projects into the plug insertion portion from a bottom side of the low-height portion; wherein the housing has a low-height contact accommodation portion into which the low-height contact is incorporated from an undersurface of the housing, the low-height contact accommodation portion has:

a temporary fixation pressure contact portion that comes into contact with the folded portion upon incorporation of the low-height contact; and a preload portion that comes into contact with the elastic contact portion, with the low-height contact incorporated, and when the preload portion comes into contact with the elastic contact portion, the folded portion is separated from the temporary fixation pressure contact portion.

* * * * *